US010505306B2

(12) United States Patent
Listing et al.

(10) Patent No.: US 10,505,306 B2
(45) Date of Patent: Dec. 10, 2019

(54) PLUG AND METHOD OF ATTACHING A VIBRATION PROTECTION TO A PLUG

(71) Applicant: TE Connectivity Germany GmbH, Bensheim (DE)

(72) Inventors: Martin Listing, Langen (DE); Walter Saenger, Fuerth (DE); Wolfgang Balles, Mannheim (DE); Kai Kioschis, Landau (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/976,353

(22) Filed: May 10, 2018

(65) Prior Publication Data

US 2018/0331451 A1 Nov. 15, 2018

(30) Foreign Application Priority Data

May 11, 2017 (DE) ..... 10 2017 208 008

(51) Int. Cl.

| | |
|---|---|
| ***H01R 13/627*** | (2006.01) |
| ***H01R 13/426*** | (2006.01) |
| ***H01R 13/41*** | (2006.01) |
| ***H01R 13/08*** | (2006.01) |
| ***H01R 13/533*** | (2006.01) |
| ***H01R 31/06*** | (2006.01) |
| *H01R 13/11* | (2006.01) |
| *H01R 13/52* | (2006.01) |
| *H01R 13/58* | (2006.01) |
| *H01R 13/629* | (2006.01) |

(52) U.S. Cl.

CPC ..... *H01R 13/426* (2013.01); *H01R 13/08* (2013.01); *H01R 13/41* (2013.01); *H01R 13/533* (2013.01); *H01R 31/06* (2013.01); *H01R 13/113* (2013.01); *H01R 13/5205* (2013.01); *H01R 13/5219* (2013.01); *H01R 13/5825* (2013.01); *H01R 13/629* (2013.01); *H01R 2201/26* (2013.01)

(58) Field of Classification Search

CPC ..... H01R 13/426; H01R 31/06; H01R 13/08; H01R 13/533; H01R 13/41; H01R 13/629; H01R 13/5825; H01R 13/5219; H01R 13/5205; H01R 2201/26; H01R 13/113

USPC ..... 439/382, 383, 384, 385

See application file for complete search history.

(56) References Cited

U.S. PATENT DOCUMENTS

| | | | | |
|---|---|---|---|---|
| 7,588,454 B2 * | 9/2009 | Nakata | H01R 13/6277 | 439/352 |
| 2008/0233796 A1 * | 9/2008 | Segrt | H01R 13/5205 | 439/578 |
| 2011/0171843 A1 * | 7/2011 | Casses | B60L 11/1818 | 439/188 |
| 2016/0134050 A1 * | 5/2016 | Umbach | H01R 13/622 | 439/382 |

* cited by examiner

*Primary Examiner* — Abdullah A Riyami
*Assistant Examiner* — Nelson R. Burgos-Guntin
(74) *Attorney, Agent, or Firm* — Barley Snyder

(57) ABSTRACT

A plug comprises a plug housing, an electrically conductive plug contact disposed in the plug housing, a contact body cooperating with the plug contact, and a slider displaceably guided in a sliding guide formed on the plug housing. The slider has a ramp surface cooperating with the contact body such that the contact body is pushed against the plug contact when the slider is slid into the plug housing.

17 Claims, 9 Drawing Sheets

PLUG AND METHOD OF ATTACHING A VIBRATION PROTECTION TO A PLUG

CROSS-REFERENCE TO RELATED APPLICATION

This application claims the benefit of the filing date under 35 U.S.C. § 119(a)-(d) of German Patent Application No. 102017208008.6, filed on May 11, 2017.

FIELD OF THE INVENTION

The present invention relates to a plug and, more particularly, to a plug having a plug housing and an electrically conductive plug contact.

BACKGROUND

Known plugs or plug connectors, used in a variety of applications, have a plug housing and an electrically conductive plug contact disposed in the plug housing. The plug contact is generally formed from a plate of metal and has surfaces cooperating with a mating plug contact of a mating plug connector to form an electrically conductive path inside the mated connectors.

The dimensions and in particular a cable cross-section of the electrically conductive plug contact depends on the strength of the current which is to be transferred via the plug connection. The plug contacts are generally produced from a sheet material by stamping and bending. The quality of an electrical contact between the plug contact and the mating plug contact is influenced by forming elastic protrusions and other elements molded integrally on the sheet plate for securely electrically transferring and mechanically securing the plug contact. Additional devices are known which mechanically connect plug housings of plug connectors and mating plug connectors to each other in order to avoid the plug connector and mating plug connector from disconnecting during operation. In certain applications, such as for a plug connector used to connect various components inside an electric vehicle, the plug connector can be subject to vibration.

It is known to use a box spring to secure the mechanical and electrical contact of the plug contact and mating plug contact. The box spring engages over at least one of the plug contact and mating plug contact and additionally secures the contacts against each other and/or the plug housing. The box spring, however, does not offer the necessary security against defective attachment. Production processes, in particular in the motor vehicle industry, must also be made largely automated and verifiable, which is not completely possible with a box spring. Moreover, the box spring generally consists of an electrically conductive material which, with regard to the air and creepage distances, is not usable in a high-voltage application. Separate plastic clips are also known that are guided via the plug contact in order to connect it to the plug housing or the mating plug contact or the housing thereof. The clips, however, are not sufficiently resistant to vibrations. This applies in particular to plugs in the field of high-voltage application which have an electrically conductive plug contact with relatively great wall thickness in order to guide the relatively high power current, and which consequently on their own have a relatively high rigidity; in such case the clips formed from plastic can only contribute a low additional force to secure and fix the plug contact.

An inadequate contact of the plug contact with the housing and/or the mating plug contact of the mating plug connector results in the plug contact floating in the plug housing and thus in significant wear at the contact surface between the plug contact and mating plug contact. Finally, this results in contact resistances on the contact surface between the plug contact and mating plug contact, which can result in failures, and where applicable also in high transfer resistances and thus in supercritical temperatures inside a plug connection.

SUMMARY

A plug comprises a plug housing, an electrically conductive plug contact disposed in the plug housing, a contact body cooperating with the plug contact, and a slider displaceably guided in a sliding guide formed on the plug housing. The slider has a ramp surface cooperating with the contact body such that the contact body is pushed against the plug contact when the slider is slid into the plug housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
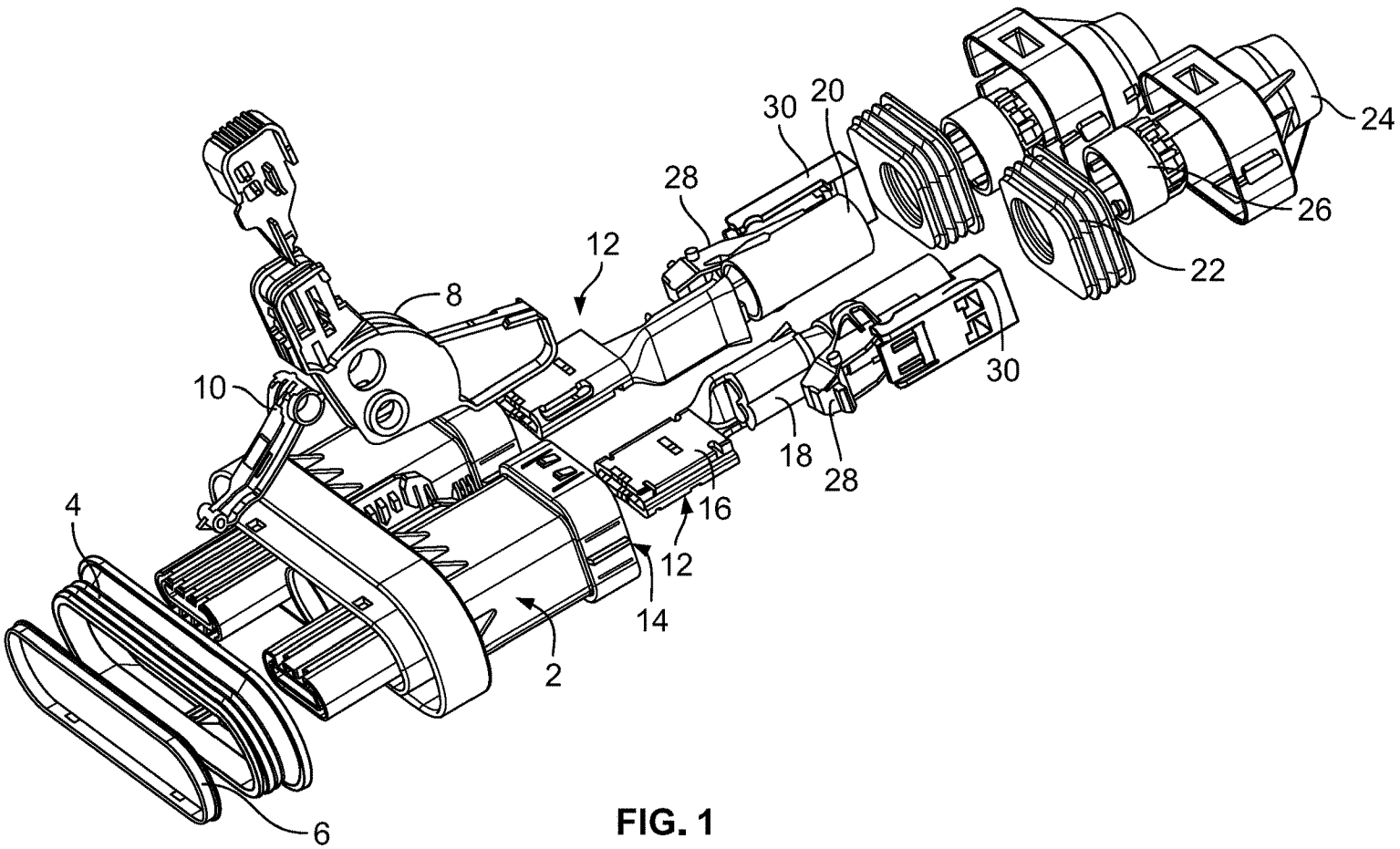
FIG. 1 is an exploded perspective view of a plug connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A plug connector according to an embodiment is shown in FIG. 1. The plug connector includes a plug housing 2 having a seal 4 on a front side of the plug housing 2. The seal 4 is connected to the plug housing 2 by a seal retainer 6. In the embodiment shown in FIG. 1, the plug housing 2 supports a lever 8 which pivotably bears a securing element 10 with which the plug connector can be mechanically coupled to the housing of a mating plug connector, in order to prevent the mated connection of the connectors from being released.

The plug housing 2, in the embodiment shown in FIG. 1, receives two plug contacts and therefore has two plug contact receiving chambers 14 which are spaced apart from each other. A pivotable bearing for the lever 8 is molded between the plug contact receiving chambers 14. The plug contact 12 is molded from a stamped and bent sheet plate and has a contact region 16, which in the shown embodiment is molded as a female element and substantially cylindrically with a rectangular cross-section, and a cable receptacle 18 which is molded integrally thereon in the shape of a crimp sleeve. A stripped end of a cable 20 is exposed in the cable receptacle 18 and is connected to the cable receptacle 18 by crimping. The cable 20 is guided through an individual conductor seal 22 and extends out through a cover cap 24 out of the plug housing 2. A strain relief 26 is located between the cover cap 24 and the individual conductor seal 22. The strain relief 26 cooperates with the jacket of the cable 20 and, via the cover cap 24, is pretensioned in the radial direction on the jacket of the cable 20 in order to hold it in the plug housing 2.

A vibration protection unit 32 for protecting the cable 20 in the plug housing 2 against vibration includes a contact body 28 and a slider 30 shown in FIG. 1. As shown in FIG. 1, each cable 20 has a unit 32.

Figure 2:
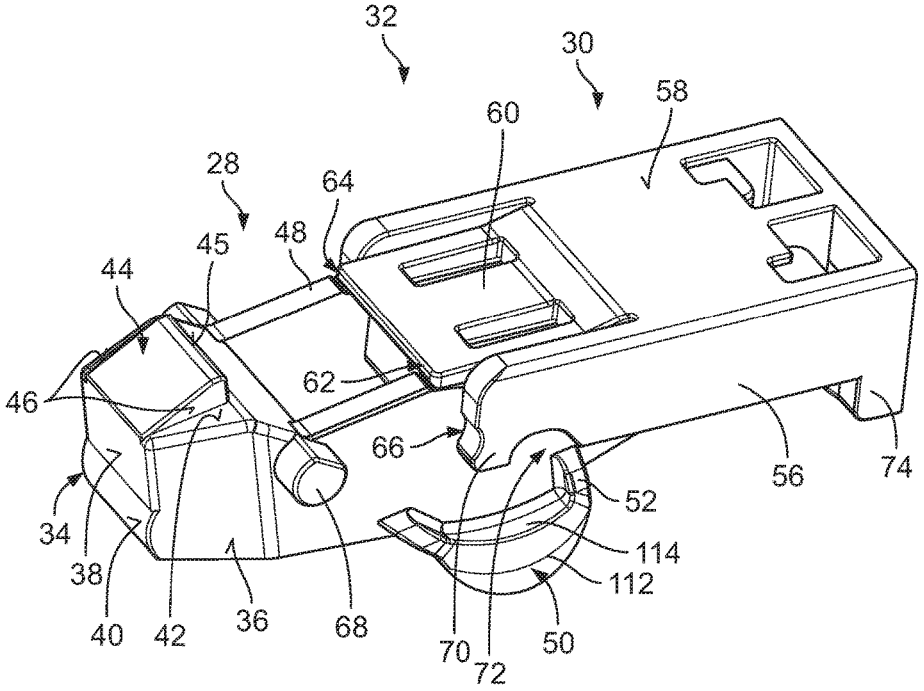
FIG. 2 is a side perspective view of a contact body and a slider of the plug connector.

The vibration protection unit 32 is shown in greater detail in FIG. 2. The contact body 28 has a top region 34 which is formed conically tapering toward its free end. Mutually opposing flank surfaces 36 of the contact body 28 conically taper towards each other, are delimited by a facing surface 38, and are connected by the facing surface 38. The facing surface 38 is substantially planar and is projected beyond on its lower end by a convexly curved contact surface 40. A top surface 42 which is provided opposite thereto and connects the two flank surfaces 36 to each other is projected beyond by a wedge segment 44, which has a surface area which is rectangular in the plan view and indented inwardly relative to the flank surfaces 36. The wedge segment 44 forms a retaining edge 45 extending perpendicular on the top surface 42, and wedge guide surfaces 46 which deviate from the top surface 42 at a right angle. These wedge guide surfaces 46 are parallel to a sliding direction which is identified by S in FIG. 3.

The top region 34 of the contact body 28 connects two contact arms 48 which extend substantially parallel to each other and are projected beyond on the underside by clamping segments 50, as shown in FIG. 2. The clamping segments 50 are integrally connected to the contact arms 48 via clamping segment connection webs 52; the connection between the clamping segment 50 and the associated contact arm 48 is over an entire surface of the clamping segment 50. Beyond the clamping segment connection webs 52, a relatively thin-walled connection is provided, such that the clamping segments 52 relative to the contact arm 48 are pivotable about a pivot axis SW shown in FIG. 5, which extends substantially parallel to the sliding direction S. Other than the clamping segments 50, the contact arms 48 have a substantially rectangular cross-sectional geometry, and are each projected beyond on the inside by a retaining cam 54 shown in FIGS. 3A-3C. The slider 30 is joined to the contact body 28 by the retaining cams 54.

The slider 30, as shown in FIG. 2, has a substantially rectangular top surface 58 connecting flanks 56 transitioning on the front end of the slider 30 into a spring 60. The spring 60 is cut free laterally relative to the flanks 56 and is arranged offset inwards relative to the plane formed by the top surface 58. On its free end, the limb 60 forms a latching protrusion 62 which engages in an undercut 64 of the contact body 28 in a joined state of the unit 32. The front end of each of the flanks 56 has a concave-shaped receiving depression 66 which is formed adapted to the contour of an axial cam 68 of the contact body 28. The axial cam 68 projects from the contact body 28 at an intersection between the flank surface 36 and the contact arm 48 and extends transversely to the sliding direction S. The contact body 28 has two axial cams 68 which are provided on the outside. The receiving depression 66 is formed on the facing surface of the respective flanks 56 of the slider 30, specifically on an end limb 70 which is deliberately weakened via a free punch 72.

Figure 5:
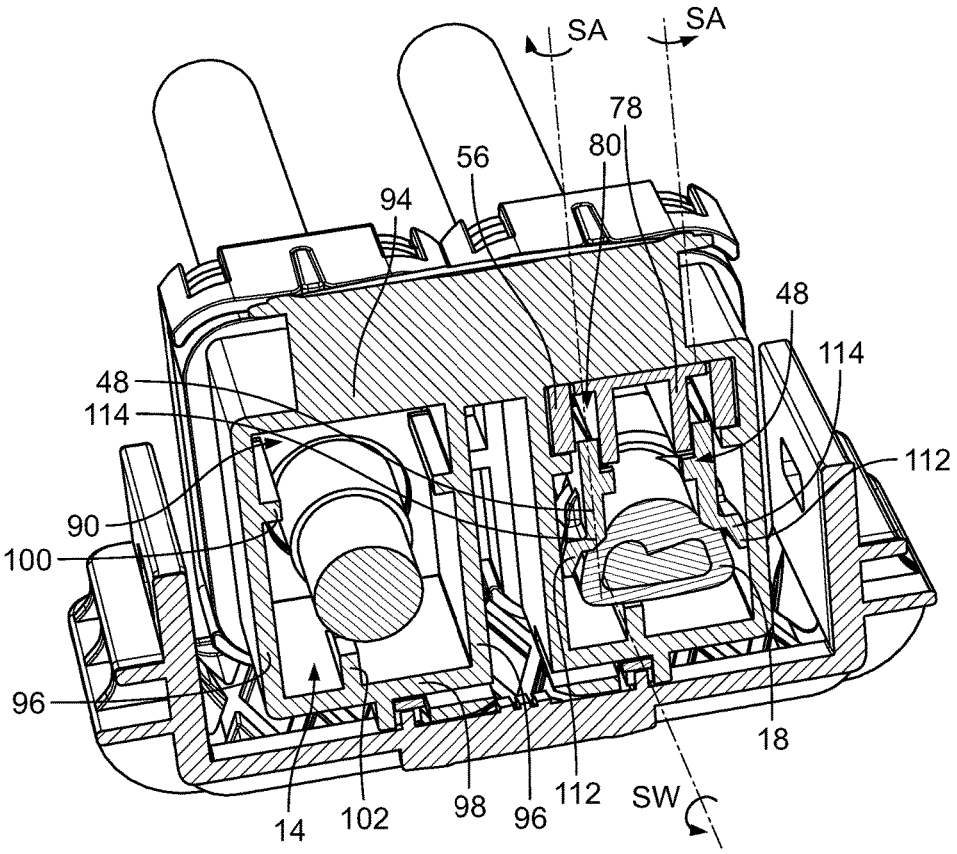
FIG. 5 is a sectional perspective view of the contact body and the slider in the end position in the plug housing.
Figure 6:
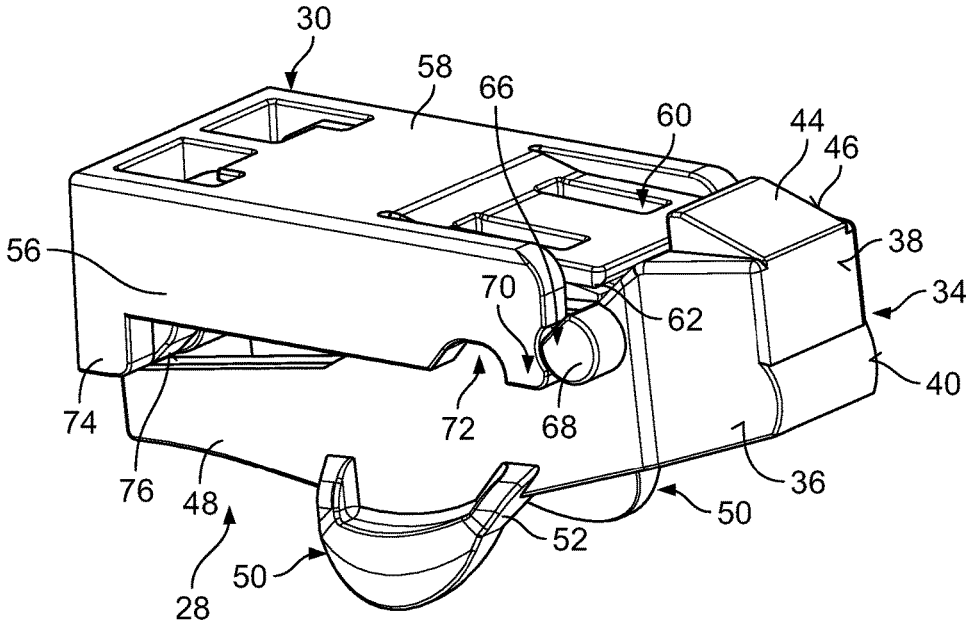
FIG. 6 is a side perspective view of the contact body and the slider in the end position.
Figure 7:
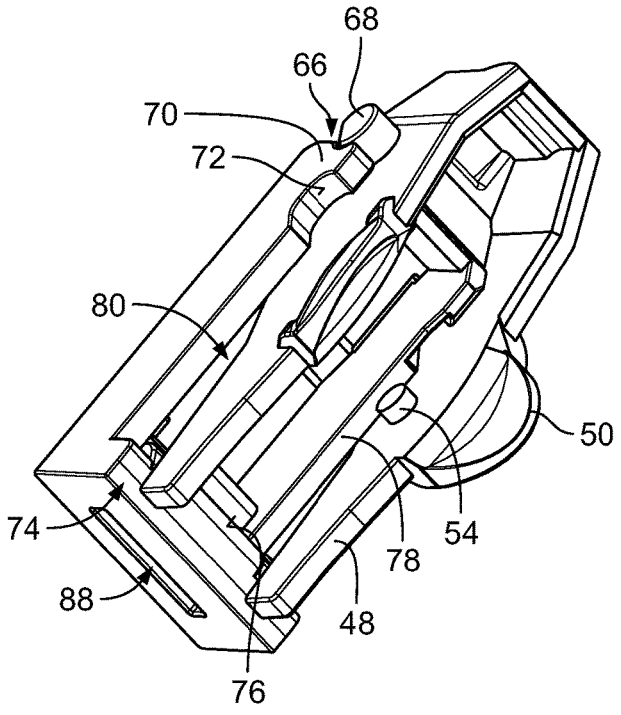
FIG. 7 is a bottom perspective view of the contact body and the slider in the end position.

In a side profile, the slider 30 is formed in a substantial L-shape by a tightening cam 74 as shown in FIG. 2. The tightening cam 74 has a convexly curved ramp surface 76, as shown in FIGS. 6 and 7, which cooperates with the free ends of the contact arm 48 in the end position shown in FIG. 4H. The slider 30 has inner flanks 78 which extend parallel to the outer flanks 56, as shown in FIGS. 5 and 7, in order to form a contact arm receptacle 80 therebetween. When the unit 28 is joined, the free ends of the contact arms 48 are received in the contact arm receptacle 80. On its ends which are delimited by the tightening cam 74, the contact arm receptacles 80 have a geometry pressing the contact arms 48 out of the contact arm receptacle 80. The contact arm receptacles 80 form a counter bearing 81, shown in FIGS. 3A and 3B, which is tiered thereto and in which the free end of the contact arms 48 is received when the unit 32 is joined as shown in FIG. 3A.

Figure 3A:
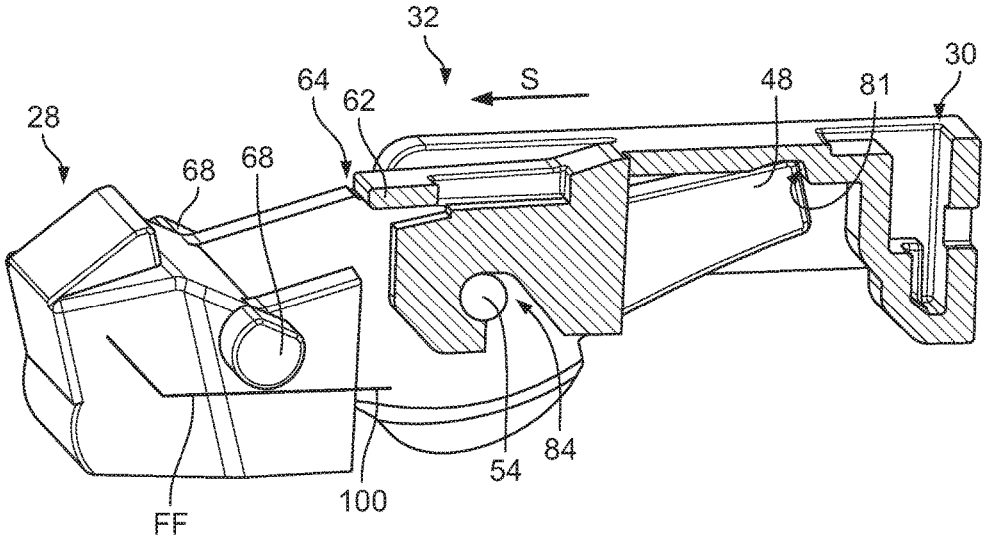
FIG. 3A is a sectional perspective view of the contact body and the slider in a first phase of undoing a connection between the contact body and the slider.
Figure 3B:
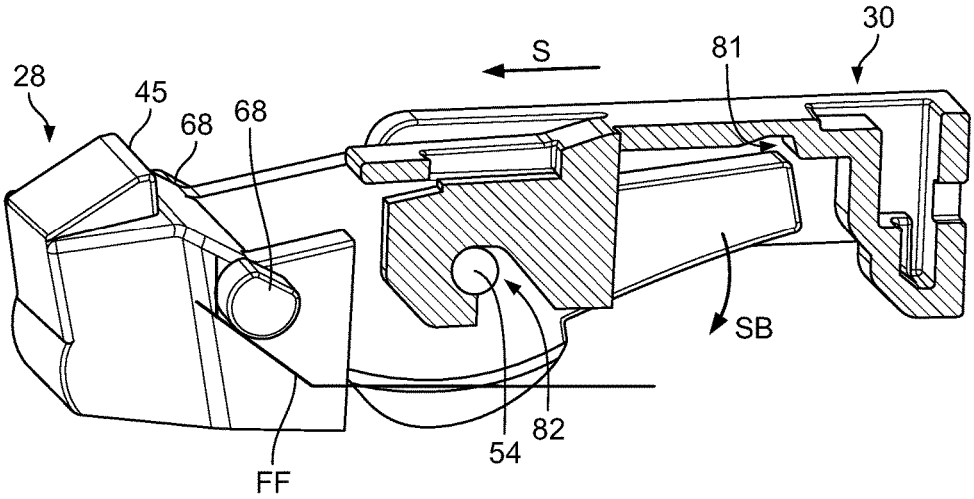
FIG. 3B is a sectional perspective view of the contact body and the slider in a second phase of undoing the connection between the contact body and the slider.

The outer surfaces of the inner flanks 78 which are facing the outer flanks 56 are each provided with a catch opening channel 82, shown in FIG. 3B, which opens up to the lower end of the inner flank 78 and which is configured obliquely to the main extension direction of the inner flank 78 and thus to the sliding direction S. The catch opening channel 82 leads to a catch 84 shown in FIG. 3A which adapted to receive the retaining cam 54. The catch 84 has an essentially C-shaped configuration in the embodiment shown in FIG. 3A.

When the slider 30 is joined with the contact body 28 to form the unit 32, as shown in FIGS. 2 and 3A, the retaining cam 54 is located inside the catch 84. The spring limb 60 bears with its latching protrusion 62 in the undercut 64. The free end of the respective contact arms 48 bears against the counter bearing 81 formed inside the contact arm receptacle 80 in a form-fitting manner. The slider 30 and the contact body 28 are connected in a releasable, form-fitting manner at these three contact points.

The connected unit 32 is slid into the plug housing 2 after the pre-assembly of the plug housing 2 with the plug contact 12 connected to the cable 20, as shown in FIGS. 4A-H. For this purpose, the slider 30 has on its rear end a slotted tool receptacle 88 which is formed to receive a tool; the unit 32 can be slid into the plug housing 2 in a precise position via this tool.

During this sliding movement, the slider 30 is guided in a sliding guide 90, shown in FIG. 5. The sliding guide 90 is delimited by an upper delimiting wall 94 of a plug contact receiving chamber 14 formed by the plug housing 2. As shown in FIG. 5, the plug contact receiving chamber 14 is molded in a substantially rectangular shape. In addition to the upper delimiting wall 94, the plug contact receiving chamber 14 has lateral delimiting walls 96 and a lower delimiting wall 98. The lateral delimiting walls 96 are projected beyond by a guide rib 100. The distance of this guide rib 100 from the upper delimiting wall 94 is adapted to the vertical extension of the outer flank 56 to form the sliding guide 90. In FIG. 5, the left plug contact receiving chamber 14 is shown without the plug contact 12 but with the cable 20 which is freed on its free end around the cable jacket. All delimiting walls 94, 96, 98 which form the plug contact receiving chambers 14 and the guide rib 100 extend parallel to the sliding direction S. A bearing web 102 projects from the lower delimiting wall 98 and bears the tubular cable receptacle 18.

Figure 4A:
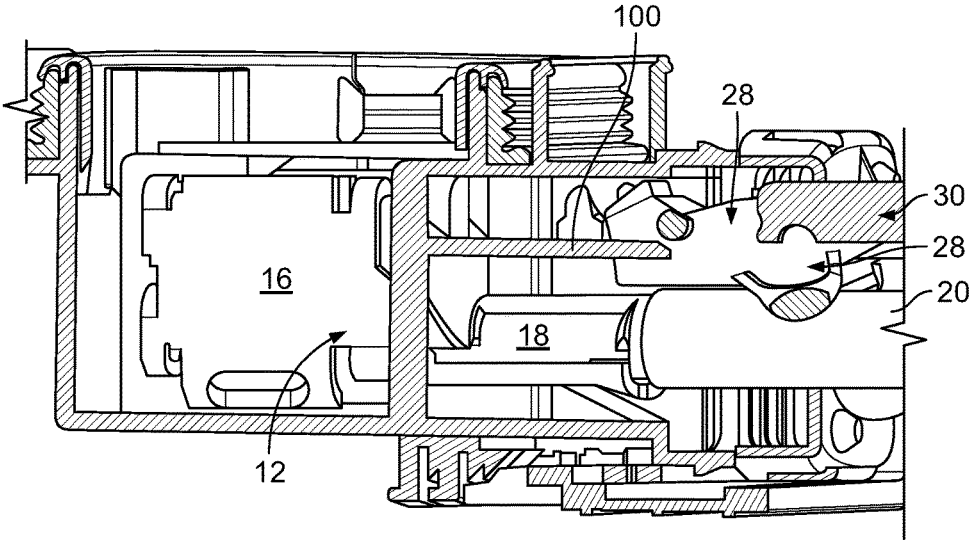
FIG. 4A is a sectional side view of a first phase of inserting the contact body and the slider into a plug housing of the plug connector.
Figure 4B:
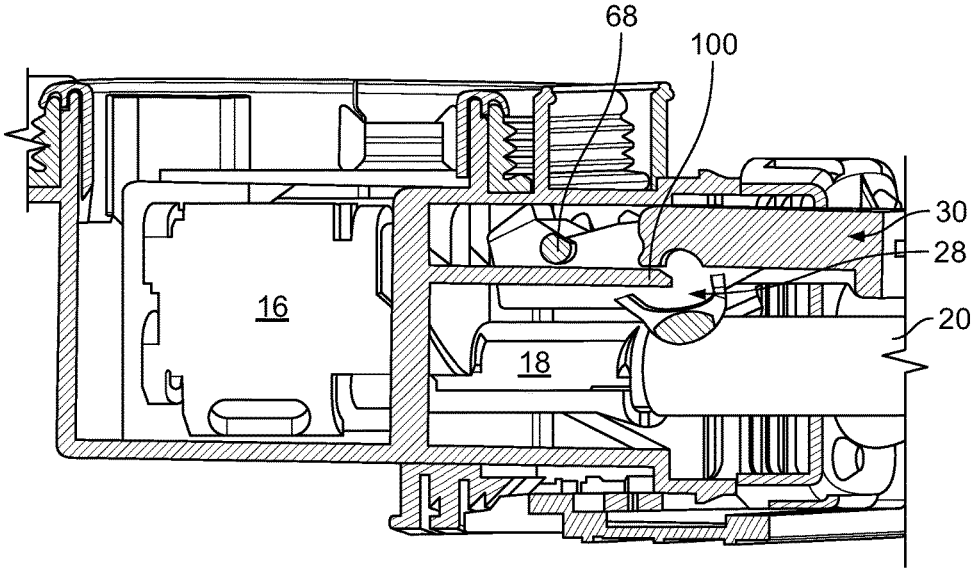
FIG. 4B is a sectional side view of a second phase of inserting the contact body and the slider into the plug housing.
Figure 4C:
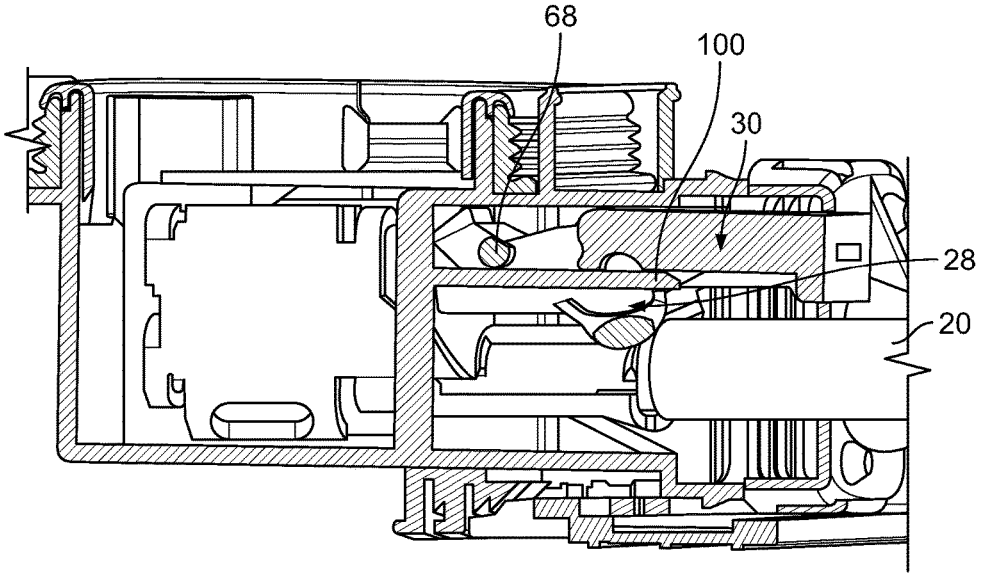
FIG. 4C is a sectional side view of a third phase of inserting the contact body and the slider into the plug housing.
Figure 4D:
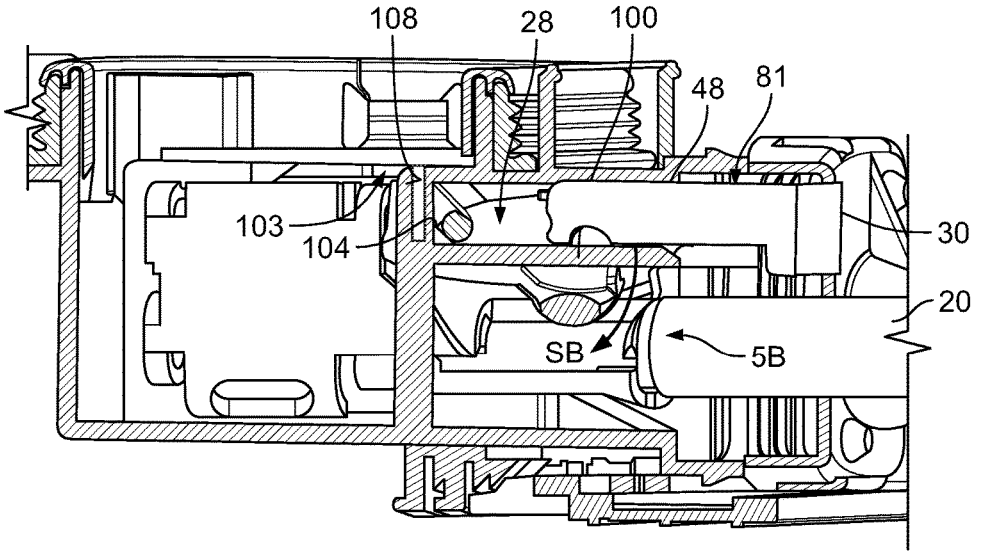
FIG. 4D is a sectional side view of a fourth phase of inserting the contact body and the slider into the plug housing.

As shown in FIG. 4D, an oblique surface 104 is located on the end of the guide rib 100 between the guide rib 100 and the upper delimiting wall 94. While sliding in the unit 32, the contact body 28 is slid forward with the slider 30 in the direction of the plug contact 12 as shown in FIGS. 4A-4C. The wedge guide surfaces 46 are guided by peripheral surfaces of a contact body receptacle 103 to displaceably bear the contact body 28, which are formed by the plug housing 2. This linear movement in the sliding direction S of the unit 32 experiences a movement at a right angle to the sliding direction S if the axial cam 68 abuts against the oblique surface 104 as shown in FIG. 4D. The top region 34 of the contact body 28 is then raised in FIGS. 4D-4H. "Raising" for the purposes of this description is understood to mean a movement of the contact body 28 transversely to the sliding direction S inside the contact body receptacle 103.

Figure 4E:
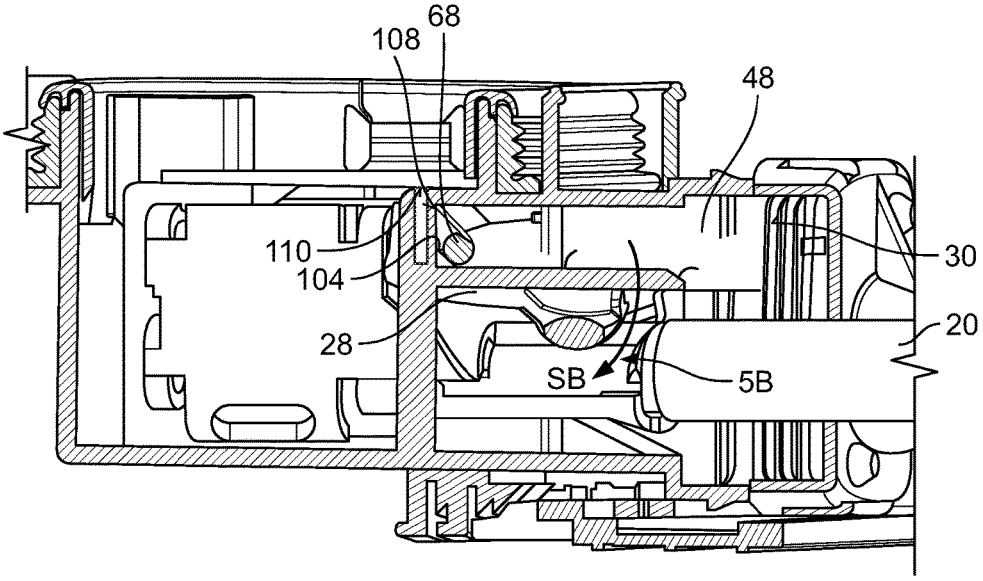
FIG. 4E is a sectional side view of a fifth phase of inserting the contact body and the slider into the plug housing.
Figure 4F:
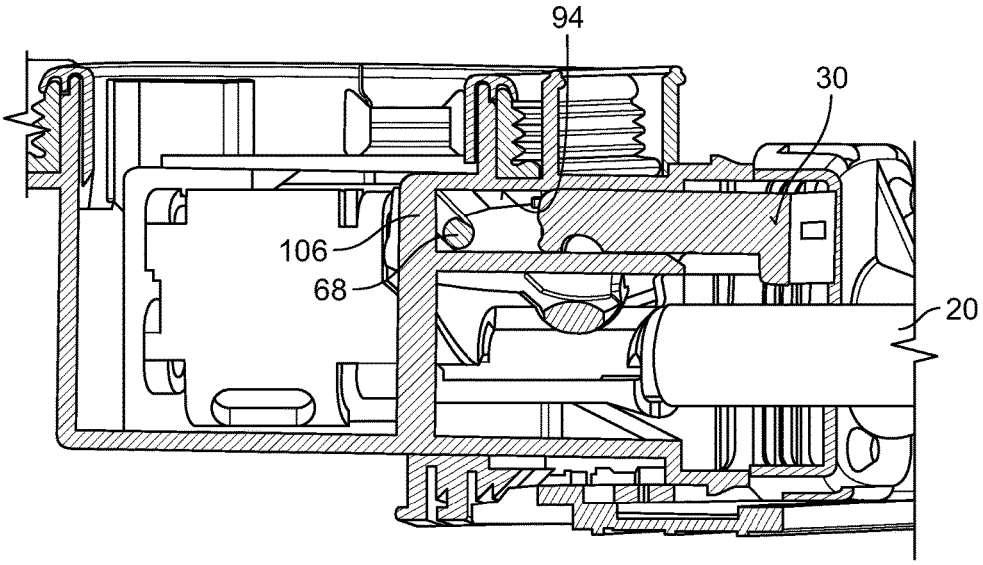
FIG. 4F is a sectional side view of a sixth phase of inserting the contact body and the slider into the plug housing.
Figure 4G:
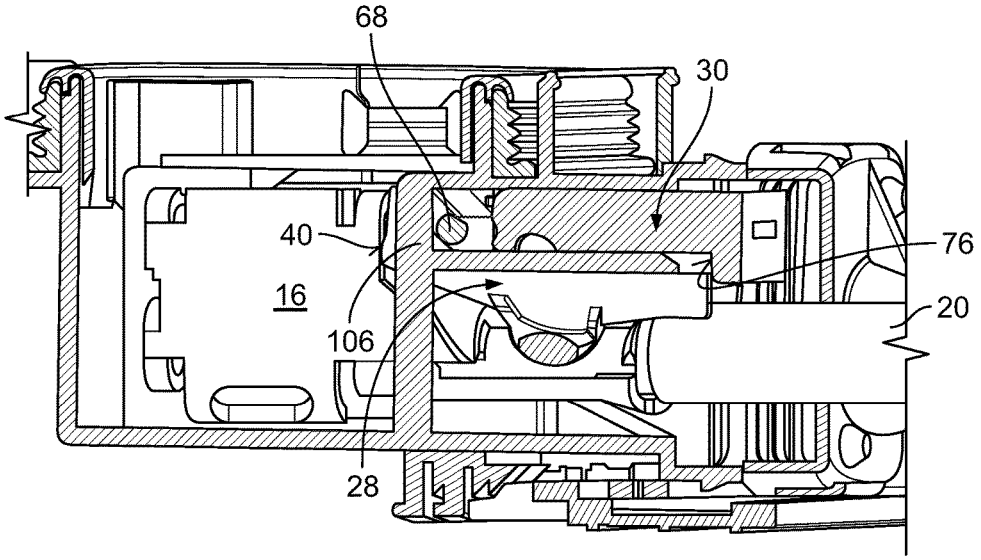
FIG. 4G is a sectional side view of a seventh phase of inserting the contact body and the slider into the plug housing.

The axial cam 68 finally pushes against an end-side delimiting wall 106 of the sliding guide 90 extending transversely to the sliding direction S in an intermediate position of the contact body 28 shown in FIGS. 4F and 4G. A further sliding of the slider 30 from the intermediate position results in a movement relative to the contact body 28 and an initial separation of the unit 32. After the contact body 28 abuts against a stop on the side of the housing 2 in the intermediate position, any displacement of the slider 30 then results in a relative movement of the slider 30 and contact body 28. A pivoting movement of the contact body 28 relative to the slider 30 is thereby created and will be described in greater detail below.

By gliding against the oblique surface 104, the retaining edge 45 formed by the wedge segment 44 is guided behind a locking surface 108 shown in FIGS. 4D and 4E. The locking surface 108 is formed by the plug housing 2 and is delimited on the upper side of a bearing surface 110 which extends in the sliding direction S. The surfaces 108, 110 thus delimit the contact body receptacle 103. This movement is also illustrated in the sequence of FIGS. 3A to 3B; a guide surface FF formed by the guide rib 100 and the oblique surface 104 of the plug housing 2 being schematically added for the axial cam 68. During the sliding movement, the conically tapering flank surfaces 36 are pushed into a conical receptacle formed by the plug housing 2, whereby a forced centering of the contact body 28 to a central longitudinal axis can be facilitated by the plug housing 2 which extends in the sliding direction S.

During a pivoting movement shown in FIGS. 4D-4H, the top surface 42 approaches the upper delimiting wall 94. At the same time, the edge 45 of the contact body 28 approaches the surface 108 of the plug housing 2 standing transverse and perpendicular to the sliding direction S and prevents the plug contact 16 from being pulled out of the plug housing 2 with the bulbously formed stop surface 40 of the contact body 28 and the plug contact 16. Moreover, by a wedging of the ramp surface 76 of the arm 48 located on the contact body 28 with the cam 74 of the slider 30, which is supported on the upper delimiting wall 94, a tensioning of the top surface 42 of the contact body 28 with the upper delimiting surface 94, and, as an opposing bearing, the pairing of the axial cam 68 and the oblique surface 104 is achieved. In the case of a marginal tolerance position, the axial cam 68 can also come to bear against the delimiting wall 106. Furthermore, a tensioning between the bulbously formed stop surface 40 of the contact body 28 and the plug contact 16 is thus achieved via the edge 45 and the surface 108 of the plug housing 2. As a result, the plug contact 16 is firmly connected to the plug housing 2, which results in a significantly improved vibration resistance of the plug contact 16.

The raising of the top region 34 over the oblique surface 104 ends when the wedge segment 44 abuts against the bearing surface 110. When advancing the contact body 28, it is slid with its top region 34 into a conical receptacle which is formed by the plug housing 2 and which is formed corresponding to the long surfaces; a centering of the contact body 28 is thus secured in the end position. When advancing the contact body 28, the front end of the contact body 28 which is guided by the wedge guide surfaces 46 to mating surfaces of the contact body receptacle 103, in order to align the contact body 28 from the outset to the centered configuration in the end position.

Figure 3C:
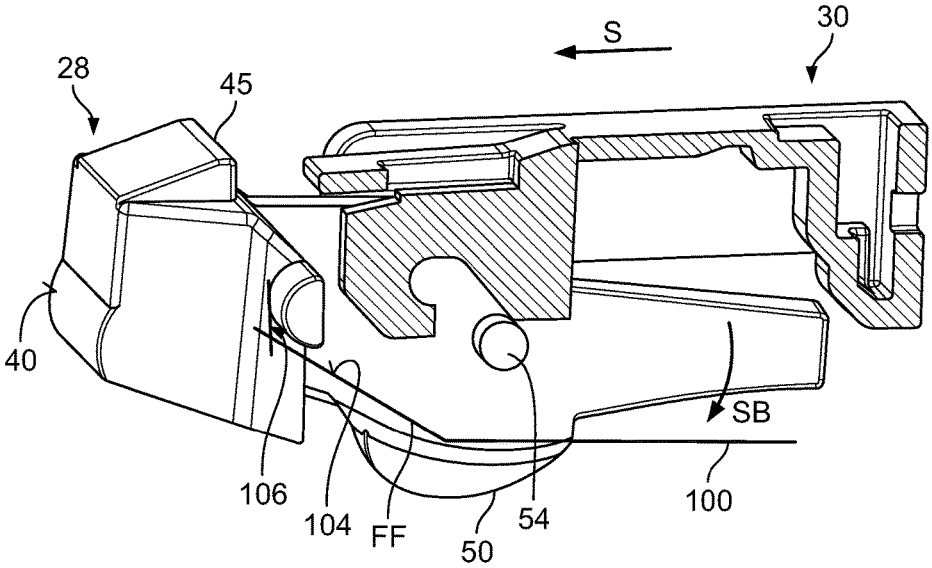
FIG. 3C is a sectional perspective view of the contact body and the slider in a final phase of undoing the connection between the contact body and the slider.

When undoing the unit 32 with elastic deformation, the spring limb 60 releases the form-fitting engagement in the undercut 64. At the same time, the retaining cam 54 is pressed out of the catch 84, wherein, by virtue of the configuration of the catch opening channel 82, a pivoting movement SB shown in FIGS. 3A-3C relative to the sliding direction S is imparted to the contact body 28. During the pivoting movement SB, the free end of the contact arms 48 comes out of the counter bearing 81 and is pivoted in the direction of the ramp surface 46. Accordingly, the contact arms 68 are removed from the associated contact arm receptacle 80 of the slider 30 as shown in the sequences of FIGS. 3A-3C and the sequence of FIGS. 4D and 4E.

In the pivoting movement SB of the contact body 28, during further advancing of the slider 30, the convex contact surface 40 lies against a contour of the plug contact 12 which extends substantially transversely to the sliding direction S and which is formed by the contact region 16 as shown in FIGS. 4F and 4G. Moreover, the free ends of the contact arms 48 approach the cable receptacle 18 by the pivoting movement SB of the contact body 28. The clamping segments 50 are pushed into a remaining gap between the cable receptacle 18 and the lateral delimiting walls 96 of the plug contact receiving chamber 14 as shown in FIGS. 4F-4H and 5. During the progressive sliding movement, by virtue of the pressing force which acts on the free ends of the contact arms 48 via the tightening cam 94 and the contour of the slider 30 provided therein, the clamping segments 50 are pressed into the gap with an increased pressing force.

As shown in FIG. 5, a free end of the clamping segments 50 extends substantially parallel to the vertical extension of the contact arms 48 and forms a clamping web 112. Via a connection web 114 extending transversely to the vertical direction of the contact arm 48, the clamping web 112 transitions into the actual contact arm 58 which is formed flank-shaped. The transition region between the actual contact arm 48 and the connection web 114 is applied in the context of the pivoting movement of the contact body 28 in the direction of the cable receptacle 18 outwards against the cable receptacle 18. As a result, the contact arms 48 are spread, i.e. the distance of the contact arms 48 in the region of the clamping segments 50 is increased. The contact arms 48 are pivoted about a pivot axis SA which extends at a right angle to the sliding direction S. The respective contact arms 48 are accordingly pivoted outwards relative to the top region 34 and in the width direction of the plug contact receiving chamber. The free ends of the contact arms 48 thus glide over the surface of the tightening cam 74 transversely to the sliding direction S. This deformation of the contact arms 48 is enabled by the U-shaped configuration of the contact body 28, which is ensured by the fact that the contact arms 48 are only connected to each other via the top region 34, but not at their free end.

Depending on the applied tensioning force, the clamping segments 50 can additionally be pivoted about a pivot axis SW shown in FIG. 5. This pivoting movement arises by virtue of the vertical distance between the bearing of the respective contact arms 48, on the one hand on the cable receptacle 18 and on the other hand on the lateral delimiting wall 94. Consequently, the clamping segment 50, in the manner of an elastically acting wedge, is pushed into the gap between the cable receptacle 18 and the adjacent lateral delimiting wall 96 as a mating surface to the surface of the cable receptacle 18 and tensioned there. The bearing web 102 supports the cable receptacle 18 rather linearly, whereby a torque arises between the clamping force applied outwardly via the contact arms 48 and the tracking force against the bearing web 102. In the context of the tensioning of the vibration protection described here, the crimp sleeve formed from a metal sheet plate can thus also be elastically deformed within limits, which contributes to the plug contact 12 being further fastened in the plug housing 2.

Figure 4H:
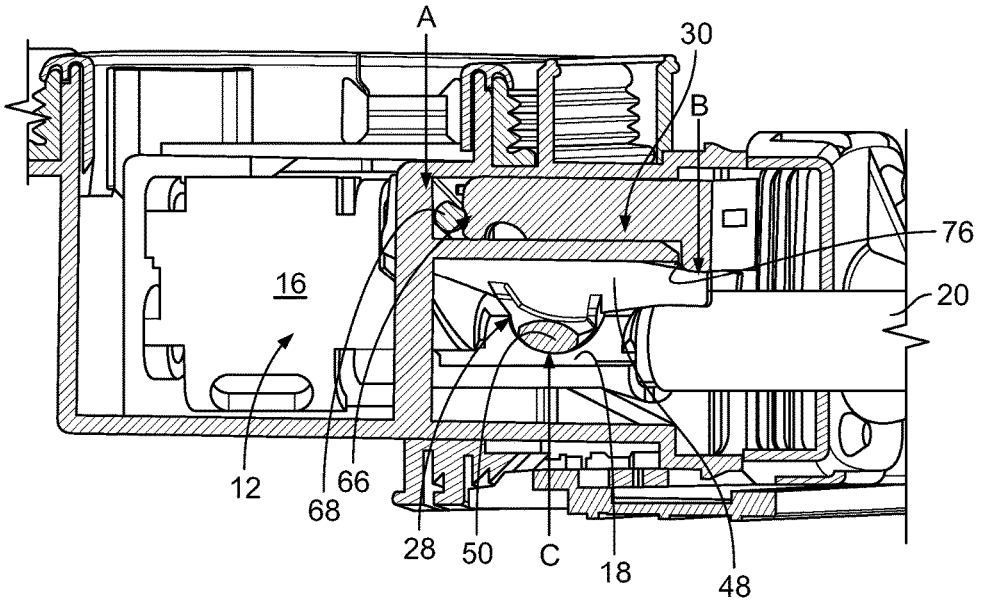
FIG. 4H is a sectional side view of an end position of inserting the contact body and the slider into the plug housing.

At the end of this sliding movement of the slider 30, the contact body 28 has reached its end position shown in FIG. 4H. As shown in FIGS. 6 and 7, the axial cam 68 bears against the receiving depression 66 in this end position. By the weakening of the end limb 7, it can pivot in the direction of the free punch 72 to elastically intercept potential voltages which can arise in the end position between the axial cam 68 and the slider 30, depending on manufacturing tolerances.

The configuration shown enables high pressing forces to fasten the plug contact 12 in the plug housing 2 in a static manner. The pressing forces are generated by elastic deformation in particular in the contact body 28 and held by the elasticity thereof. The contact body 28 is formed from a technical plastic, such as polyamide or polyethylene. The same applies to the slider 30. The two structural components can be produced monolithically and economically as complex bodies by injection molding. The recesses and openings on the slider 30, in particular in FIG. 6, are formed by movable cores of an injection molding tool, which molds the aforementioned functional surfaces inside the slider 30.

In the end position shown in FIG. 4H, three force vectors A, B, and C act on the contact body 28. Force A is transferred from the plug housing 2 via the bearing surface 110 onto the wedge segment 44. Force B is applied via the slider 30 from the plug housing 2 onto the free ends of the contact arms 48. Force C corresponds to the clamping force against the clamping segments 50 and thus to the retaining force of the contact body 28 against the cable receptacle 18. The catch 84 and the retaining cam 54 thus generally form a hinge point, about which the spring force of the spring limb 60 produces a torque which is counter borne by a free, rear end of the contact body 28 relative to the slider 30. The lever arms between the lines of action of the forces A-C or C-B can be chosen as required by the person skilled in the art, in order to set the clamping force acting on the cable receptacle 18.

What is claimed is:

1. A plug connector, comprising:

a plug housing;

an electrically conductive plug contact disposed in the plug housing;

a contact body cooperating with the plug contact; and a slider displaceably guided in a sliding guide formed on the plug housing and having a ramp surface cooperating with the contact body such that the contact body is pushed against the plug contact when the slider is slid into the plug housing.

2. The plug connector of claim 1, wherein the plug housing has an oblique surface contacting an axial cam of the contact body when the contact body is inserted into the plug housing in a sliding direction.

3. The plug connector of claim 2, wherein the axial cam is raised in a direction transverse to the sliding direction as the axial cam moves along the oblique surface during insertion, moving a retaining edge of the contact body behind a locking surface of the plug housing.

4. The plug connector of claim 1, wherein the contact body and the slider are connected to form a vibration protection unit inserted into the plug housing in a sliding direction.

5. The plug connector of claim 4, wherein the contact body is stopped at an intermediate position during insertion of the vibration protection unit into the plug housing, further insertion of the slider in the sliding direction from the intermediate position leads to a disconnection of the contact body and the slider and a movement of the slider relative to the contact body.

6. The plug connector of claim 5, wherein the slider has a spring limb with a latching protrusion engaging an undercut of the contact body to form the vibration protection unit.

7. The plug connector of claim 6, wherein the slider has a catch receiving a retaining cam of the contact body, the spring limb of the slider bearing against the contact body when the retaining cam is received in the catch.

8. The plug connector of claim 4, wherein the contact body is formed in a U-shape and has a pair of contact arms.

9. The plug connector of claim 8, wherein the vibration protection unit is inserted into the plug housing to an end position and the contact arms are pushed between a cable receptacle and a mating surface of the plug housing in the end position.

10. The plug connector of claim 8, wherein the contact arms each have a clamping segment projecting from the contact arm in a direction opposite the slider, each clamping segment having an angled cross-sectional shape.

11. The plug connector of claim 9, wherein the contact body has a convexly curved stop surface cooperating with a contact region of the plug contact in the end position.

12. The plug connector of claim 11, wherein the convexly curved stop surface is disposed on a top region of the contact body, the top region tapering in the direction of the contact region.

13. The plug connector of claim 11, wherein the contact body has an axial cam engaging a receiving depression of the slider in the end position.

14. A method of attaching a vibration protection to a plug connector, comprising:

electrically connecting a plug contact forming a cable receptacle to a cable;

inserting the plug contact into a plug housing;

sliding a vibration protection unit including a slider connected to a contact body into the plug housing in a sliding direction until the contact body abuts against the plug housing in an intermediate position; and displacing the slider from the intermediate position in the plug housing to disconnect the slider from the contact body and push the contact body against the plug contact by a relative displacement movement of the slider, fixing the plug housing in an end position.

15. The method of claim 14, wherein the contact body is pivoted in the plug housing by the relative displacement movement of the slider.

16. The method of claim 15, wherein a retaining edge of the contact body is guided behind a locking surface of the plug housing before the slider is disconnected from the contact body.

17. The method of claim 16, wherein, when approaching the end position, a pair of contact arms of the contact body extending parallel to the sliding direction are pivoted about a pivot axis which extend substantially transverse to the sliding direction.

* * * * *